US006905127B2

(12) United States Patent
Lester

(10) Patent No.: US 6,905,127 B2
(45) Date of Patent: Jun. 14, 2005

(54) RETRACTABLE FOOT GEAR FOR DISABLED PERSONS

(76) Inventor: Debbie A. Lester, 1815 N. Ross St., Santa Ana, CA (US) 92706

( * ) Notice: Subject to any disclaimer, the term of this patent is extended or adjusted under 35 U.S.C. 154(b) by 0 days.

(21) Appl. No.: 10/427,457

(22) Filed: May 1, 2003

(65) Prior Publication Data

US 2004/0061295 A1 Apr. 1, 2004

Related U.S. Application Data

(60) Provisional application No. 60/414,241, filed on Sep. 27, 2002.

(51) Int. Cl.[7] ..... A63C 17/00; A63C 17/18; A63C 1/00; A43B 5/04

(52) U.S. Cl. ..... 280/11.28; 280/11.19; 280/7.13; 280/841; 36/115

(58) Field of Search ..... 280/11.25, 11.24, 280/11.19, 11.225, 11.226, 11.227, 11.232, 11.27, 11.28, 7.13, 7.17, 841, 9; 36/115, 116; 301/5.301, 5.305

(56) References Cited

U.S. PATENT DOCUMENTS 3,351,353 A * 11/1967 Weitzner ..... 280/7.13
3,983,643 A * 10/1976 Schreyer et al. ..... 36/115
4,333,249 A * 6/1982 Schaefer ..... 36/115
5,207,454 A * 5/1993 Blankenburg et al. ..... 280/843
5,398,970 A * 3/1995 Tucky ..... 280/841
5,797,609 A * 8/1998 Fichepain ..... 280/11.19
5,882,018 A * 3/1999 Petrosino ..... 280/7.13
6,247,708 B1 * 6/2001 Hsu ..... 280/11.223
6,343,800 B2 * 2/2002 Clementi ..... 280/11.233
6,386,555 B1 * 5/2002 Kao ..... 280/7.13
6,412,791 B1 * 7/2002 Chu ..... 280/11.19
6,536,785 B2 * 3/2003 Lee ..... 280/11.27
6,739,602 B2 * 5/2004 Adams ..... 280/11.19

* cited by examiner

*Primary Examiner*—Christopher P. Ellis
*Assistant Examiner*—G B Klebe
(74) *Attorney, Agent, or Firm*—Drummond & Duckworth

(57) ABSTRACT

The retractable foot gear 10 includes a sole 12 and a retractable wheel, ball, blade, or similar low friction element 16 which normally projects from a recess formed into the shoe's sole 12. The low friction element 16 retracts into a recess 14 when a predetermined amount of force is exerted on the low friction element 16. The low friction element 16 is additionally biased so as to automatically return to an extended position when the predetermined force is relieved. The retractable foot gear 10 assists persons with difficulty in walking, standing, or maneuvering. Moreover, the protruding low friction element enables one to slide one foot along a walking surface while minimizing the tendency of one to slip and fall.

12 Claims, 5 Drawing Sheets

RETRACTABLE FOOT GEAR FOR DISABLED PERSONS

RELATED APPLICATIONS

This application is a continuation-in-part of my U.S. Provisional Application Ser. No. 60/414,241, filed Sep. 27, 2002.

BACKGROUND OF THE INVENTION

This invention pertains to a specialized shoe to be worn on one's foot or prosthetic limb to assist one in maneuvering. Motor, neural, orthopedic, and ambulatory disabilities or injuries can hinder a person's ability of motion normally exercised while walking, running, or standing. For example, persons suffering from a brain or body injury will often have the ability to effectively use only one leg. When walking, such persons will typically place weight on their disabled leg while stepping forward with their less impaired leg. Thereafter, the person will typically shift their weight onto their "good or uninvolved" leg, while dragging their impaired leg forward on the ground. The process is repeated to provide the person with mobility.

Presently, there does not exist an aid for assisting persons to walk which is inexpensive, unobtrusive and easy-to-use. Instead, disabled persons, such as stroke victims or intensive care patients, must rely on cumbersome crutches, canes, or other persons for assistance while standing and walking. Accordingly, there is a significant need for a tool, such as a specialized shoe for enabling one to drag or propel a foot without friction while providing a stable platform which assures sure footing when body weight is applied.

With regards to specialized shoes, there exists only recreational roller-skate and roller-skate-like devices which provide lockable wheels for uninterrupted skating ability. These known specialized shoes would be hazardous to a person with a disability whose need centers upon safe maneuvering.

For example, U.S. Pat. No. 6,406,038 to Adams discloses a shoe with a wheel that can be conveniently converted from a shoe to a wheeling device, but requires that the wheel be purposefully and actively retracted and locked into place. Such devices cannot automatically respond to the special needs of disabled or injured persons needing immediate support or rehabilitative therapy. In addition, such apparatus requires a learned skill of balance, positioning, and coordination.

U.S. Pat. No. 4,928,982, to Logan describes a shoe having rotatable wheels attached to the underside of the shoe's sole. The wheels are extendable and retractable. When retracted, the shoes are used for walking. When extended, the shoes function in similar fashion to a roller skate, allowing the wearer to roll or skate on a walking surface. However, the shoes require that the wheels lock in either orientation, and thus are not suitable for use by a disabled person who has trouble walking.

Another example of a specialized roller shoe is disclosed by U.S. Pat. No. 3,351,353, to Weitzner. This reference describes a convertible roller skate or ice skate which may be converted into a walking shoe. This shoe is limited by the same disadvantage, discussed above, in that the blade or wheels, which are normally housed within a recess, require the wearer to manually withdraw the blade or wheels and lock these mechanisms to the sole of the shoe by fastener elements.

Unfortunately, though prior roller shoes are useful for enabling persons to maneuver quickly, they are not useful to a person needing to selectively drag a foot but immediately use the same foot for support. Notably, previously known wheels, which are attached at the bottom of one's shoe, were designed to not flex or yield in response to pressure asserted by the wearer. Nor do previous designs concern a mechanism by which rolling members automatically return to a predisposed position. Furthermore, these devices do not permit the rolling mechanism to be fully removed from the shoe, leaving a conventional shoe intact. Lastly, previous designs of specialized footwear clearly require that any array of wheels attached to the bottom of a shoe must be arranged in a linear array and should encompass the entire length and area of the foot and not just one localized area of the foot.

SUMMARY OF THE INVENTION

The "retractable foot gear" of the present invention provides a new structure for assisting persons to walk who otherwise have difficulty in propelling their leg forward or to step in a normal fashion. The retractable foot gear alleviates the difficulty of dragging one's foot across the ground and enables a disabled person to maneuver without human assistance and without the fear of slipping. To accomplish these results, the retractable foot gear automatically provides either a high friction surface for providing stability when a person places weight on the shoe, or a low friction surface when weight is removed from the shoe, such as when a disabled person unweights the shoe to propel it upon the ground.

To this end, the retractable foot gear includes a slip-resistant surface on the underside of a shoe for providing traction to the walking surface and a low friction member having an engagement surface for engaging a walking surface. The low friction member is preferably positioned within the shoe's sole, and is extendable to either engage a walking surface or retractable to allow the slip resistant surface to engage the walking surface. Preferably, the retractable foot gear includes a biasing means, such as one or more springs, for biasing the low friction member to an extended position below the slip-resistant surface. Advantageously, the low friction member is automatically retractable to above the slip-resistant surface when a force engages the underside of the low friction member of sufficient magnitude to overcome the force exerted by the biasing means. When the predetermined force is relieved, the low friction member automatically projects again below the shoe's slip-resistant surface so as to engage a walking surface in which to propel the leg forward.

In more specific terms, the retractable foot gear includes a slip-resistant surface on the underside of the shoe for providing traction on a walking surface. The slip resistant surface may be constructed of various materials known to those skilled in the art of shoe manufacture, such as rubber or leather. Moreover, the slip resistant surface may include ridges or grooves in similar fashion to conventional running shoes to provide greater traction. Formed in the underside of the shoe's slip resistant surface is a recess for housing the low friction member and biasing means. The recess may be formed at any location on the shoe's underside depending on the wearer's disability and physiology. However, it is believed that most persons would benefit from placement of the recess medially, underneath the person's heal or ball of the foot.

The low friction member may be constructed in various forms as can be determined by those skilled in the art. For example, the low friction member may include spherical balls, rollers, or castors. Alternatively, the low friction member may be a simple plate having an extremely low coefficient of friction, such as a plate having a teflon™ surface, which is significantly lower than the coefficient of friction of the slip resistant surface. Each of these low friction members have an "engagement surface" for engaging the ground which provide little resistance to forward, medial, and lateral movement of the shoe.

The low friction member is positioned within the shoe's recess, yet biased by the "biasing means" into a position whereby the low friction member projects partially out of the recess. The biasing means may also be constructed in various forms without departing from the spirit and scope of the invention. For example, the biasing means preferably includes a helical spring or leaf spring for biasing the low friction member downward. The spring rates will vary greatly due to a variety of factors such as the wearer's weight and disability. However, the spring rates may be determined by those skilled in the art without undue experimentation. Alternative constructions for the biasing means may also be acceptable. For example, under limited circumstances, the weight of the low friction member and gravity may combine to create a biasing means for forcing the low friction member to engage the walking surface. In operation, the biasing means causes the low friction member to automatically retract into the recess when a predetermined force engages the low friction member and automatically returns to an extended position when the force upon the low friction member is below the predetermined force or weight.

The retractable foot gear may take various forms. For example, in one embodiment, the recess and low friction member are integrated into a traditional shoe construction. In an additional embodiment, the retractable foot gear includes a sole, having a recess and low friction member, which is selectively attachable and detachable to a traditional shoe. The sole, having an integrated recess and low friction member, is securely attached to the underside of the wearer's conventional shoes using traditional fasteners such as Velcro™, straps, snaps or buckles. In this embodiment, the retractable foot gear serves as an outer shoe covering, having a recess and a low friction member having an engagement surface that automatically retracts when a predetermined force is exerted upon it. Accordingly, conventional shoes may easily and readily be converted into retractable foot gear.

DETAILED DESCRIPTION

The present invention is directed to retractable foot gear which assists persons with an inability or discomfort when walking, running, or standing. The retractable foot gear provides a mechanism for sliding the foot if necessary and, additionally, the use of a slip-resistant sole as a stable walking medium.

Figure 1:
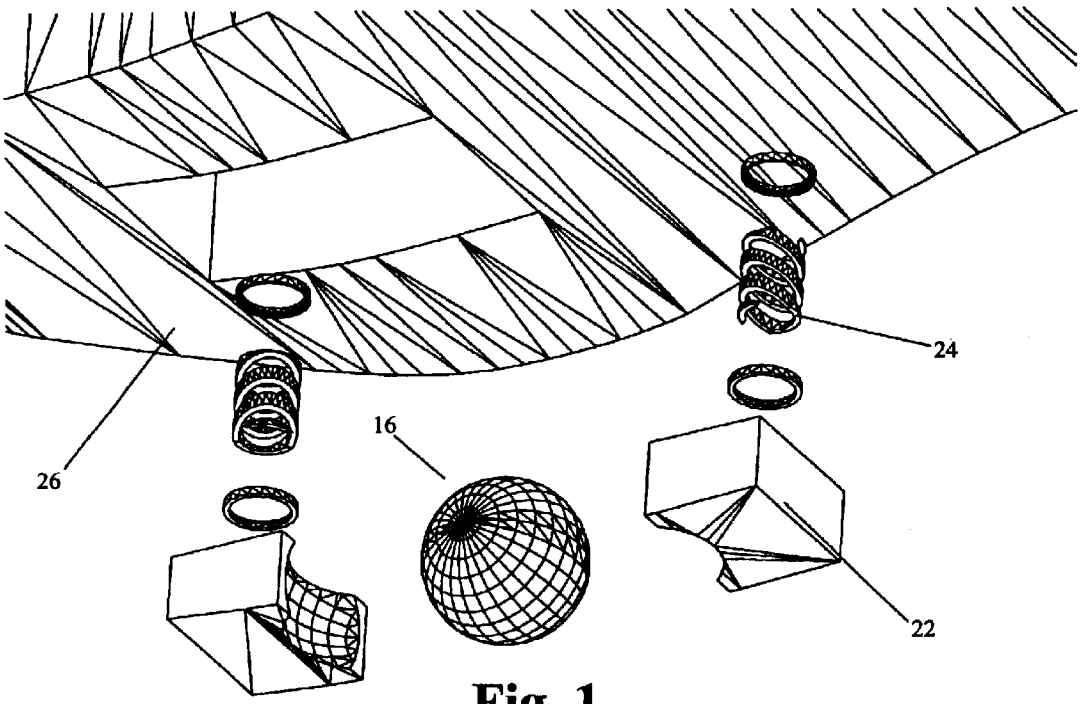
FIG. 1 is an exploded perspective view of the retractable foot gear of the present invention.
Figure 2:
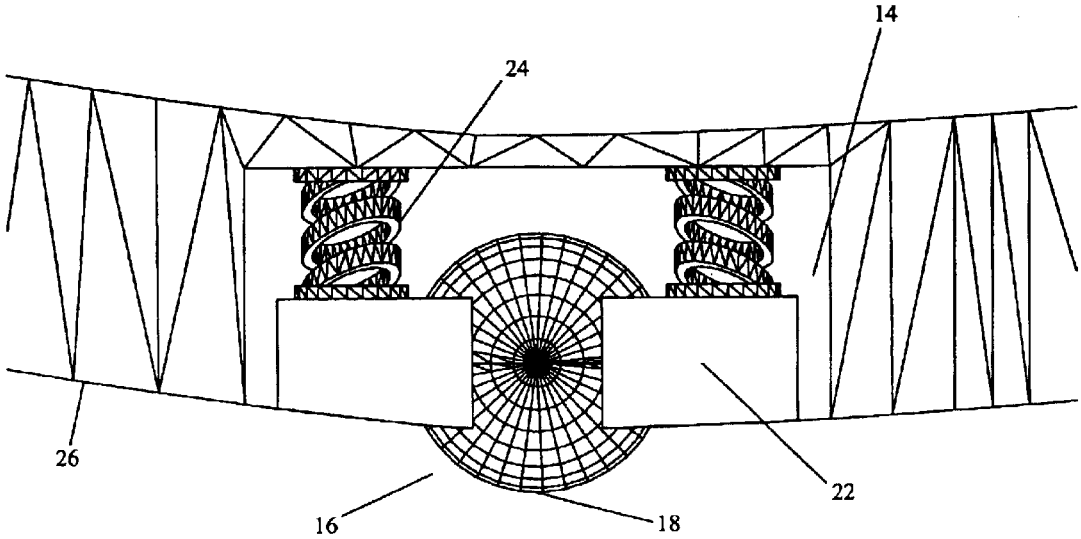
FIG. 2 is a perspective cutaway view of the retractable foot gear of the invention including a slip resistant sole, a recess and a retracted low friction member having a roller assembly, a spring assembly, and an engagement surface.
Figure 3:
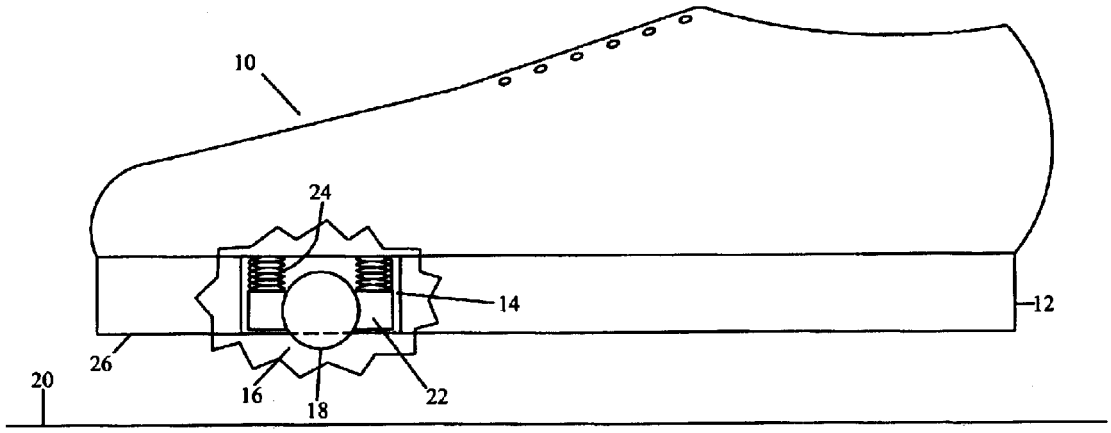
FIG. 3 is a cutaway side view of the retractable foot gear of the present invention having a slip resistant sole, a recess, and an extended low friction member having a roller assembly, a spring assembly, and an engagement surface.
Figure 4:
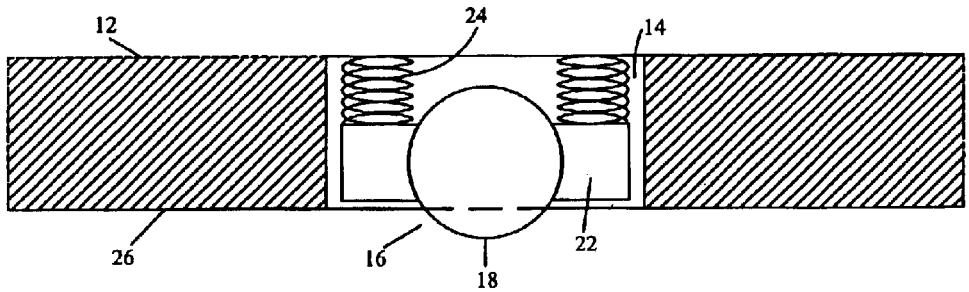
FIG. 4 is a cross-sectional side view of the retractable foot gear of the present invention having a slip resistant sole, a recess and an extended low friction member.
Figure 5:
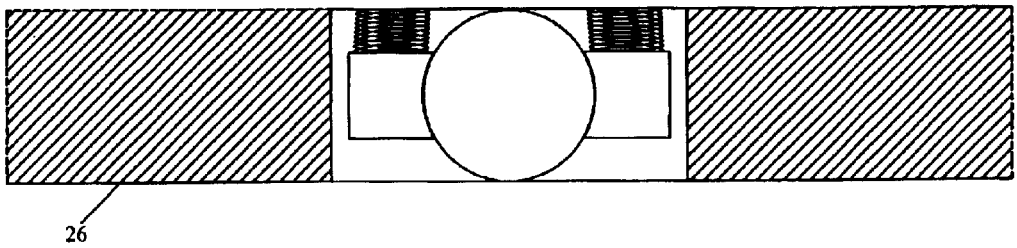
FIG. 5 is a cross-sectional side view of the retractable foot gear of the present invention having a slip resistant sole, a recess and a retracted low friction member.
Figure 6:
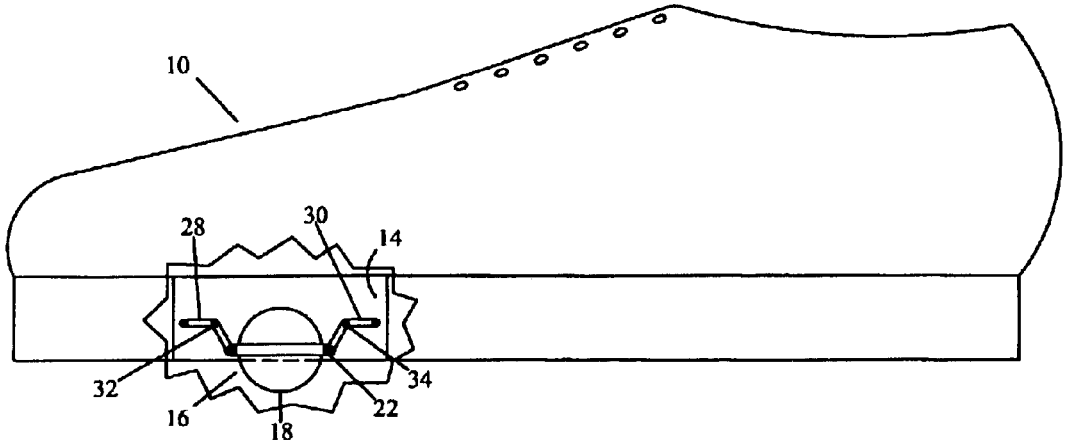
FIG. 6 is a side view of the retractable foot gear having a sole, a recess, and an extended low friction member having a roller assembly, a hinged bracket, and an engagement surface.
Figure 7:
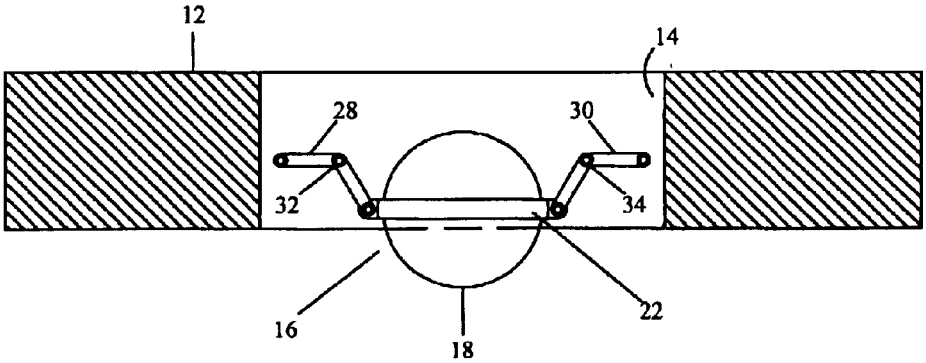
FIG. 7 is a cross-sectional side view of the retractable foot gear of the present invention including a recess and an extended low friction member having an engagement surface.
Figure 8:
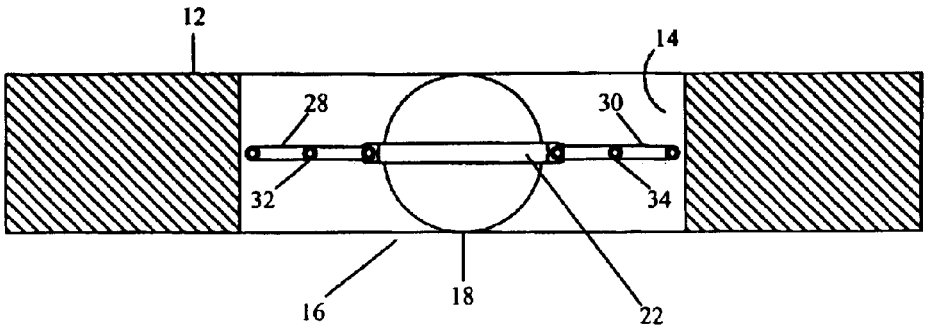
FIG. 8 is a cross section side view of the retractable foot gear having a sole, a recess and a retracted low friction member having an engagement surface.

With reference to FIGS. 1–8, in a first embodiment, the retractable foot gear 10 is constructed substantially similar to a conventional shoe including a sole 12, having a slip resistant surface 26, and an upper cover for attachment of the shoe to a person's foot. However, the retractable foot gear further includes a recess 14 housing a roller assembly 22. As shown in FIGS. 1–4, 6, 7 and 9, the roller assembly 22 includes a biasing means 24 which normally biases a low friction member 16 into an extended position such that the low friction member projects from the recess 14. However, as shown in FIGS. 5 and 8, the low friction member 16 is not locked in place by mechanical fasteners or the like so that the low friction member automatically retracts into the recess 14 when a sufficient predetermined force is applied upon the low friction member's 16 engagement surface 18. Conversely, when the predetermined force upon the low friction member 16 is relieved, the biasing means causes the low friction member 16 to automatically extend again from the recess 14.

With reference to FIG. 3, the retractable foot gear 10 may have a thicker sole 12 than is typically required by conventional foot coverings. The sole's thickness must provide ample space for integration of the recess 14 to enable the low friction member to extend from the recess to engage a walking surface 20, or retract entirely in the recess upon the walking surface exerting a force upon the low friction member. Where the wearer needs only one shoe including retractable foot gear, it is preferred, though not necessary, that the sole of the matching shoe should have a sole of similar thickness and weight for the comfort and stability of the wearer.

The roller assembly 22 may also take various constructions. As should be readily apparent from the figures, the biasing means may take any form which provides a mechanism for biasing the low friction member downward and which allows the low friction member to automatically alternate between an extended position and a recessed position with relation to the sole of the shoe. The biasing means may be a spring, hinge, a collapsible or compressible joint, groove, track, toggle, socket, swivel, or a like device, or combination thereof, that enables the low friction member to alternate between at least two positions while automatically returning to one position in the absence of some predetermined force. However preferably, the biasing means includes one or more helical springs, such as shown in the figures, or leaf springs or the like.

The predetermined force needed to retract the low friction member will vary depending on the size, weight, and individual needs of the retractable foot gear wearer. Thus, the biasing means may utilize springs having different spring coefficients depending on the needs of the shoe's wearer. Furthermore, because the appropriate predetermined force to retract the low friction member may vary from person to person, the spring coefficient may be low for some persons. Some persons, by contrast, may purposefully require a biasing means having a very high spring coefficient. The design and construction of such springs can be determined by those skilled in the art. Also preferably, the springs can be easily removed from the recess and replaced with other springs. Easy replacement of the biasing means is advantageous in case of damage, further debilitation, or progression so that the wearer of the retractable foot gear can change spring coefficients as the need demands.

Figure 9:
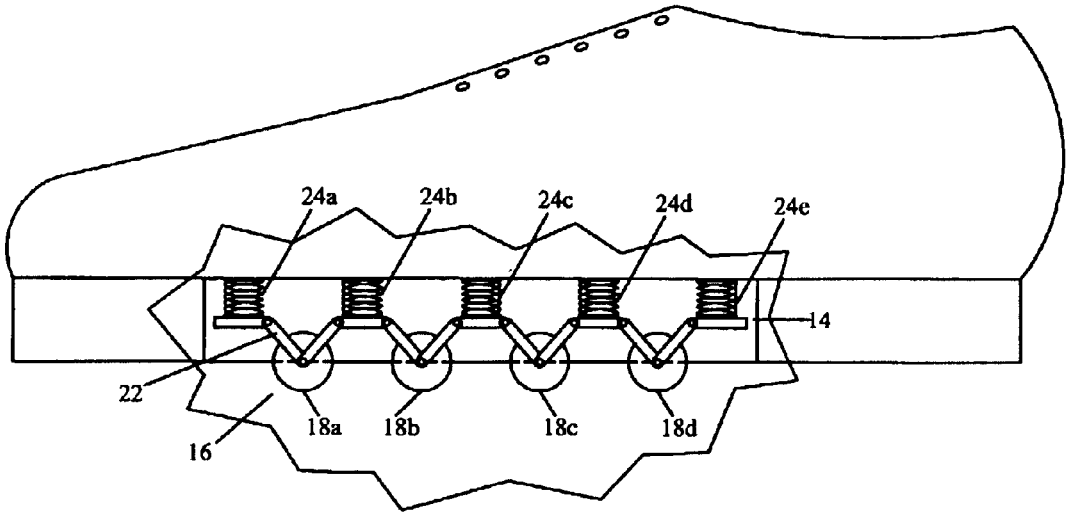
FIG. 9 is a side view of the retractable foot gear of the present invention including a low friction member having multiple engagement surfaces and spring assemblies.
Figure 10:
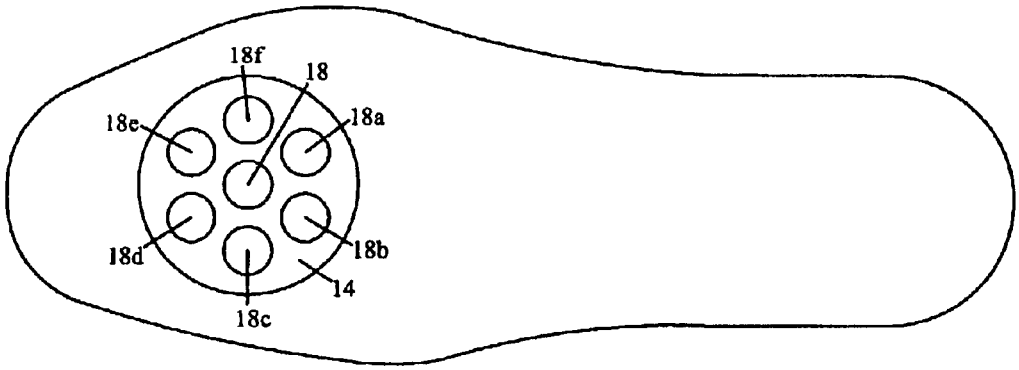
FIG. 10 is a bottom view of the retractable foot gear of the present invention having a low friction member constructed with six spherical engagement surfaces.

Additionally, the present invention is not intended to be limited to any particular construction for the low friction member. Rather, the low friction member may include any suitable structure for assisting one in sliding one's shoe across a walking surface. For example, FIGS. 1–8 and 10 illustrate roller assemblies 22 utilizing spherical balls and FIG. 9 illustrates a roller assembly 22 having wheels. However, the low friction member may be any type of apparatus useful for assisting or facilitating movement, such as, sliding or rolling, upon a walking surface. For example, wheels, balls or ball-bearings, blades, plates, castors, rotating belts or chains, or like elements may provide an engagement surface having low friction contact between the retractable foot gear and the walking surface. There are numerous suitable materials for the composition of such engagement surfaces; however, preferably the low friction member is made of a sturdy metal, plastic or composite which can be selected by one skilled in the art.

Figure 11:
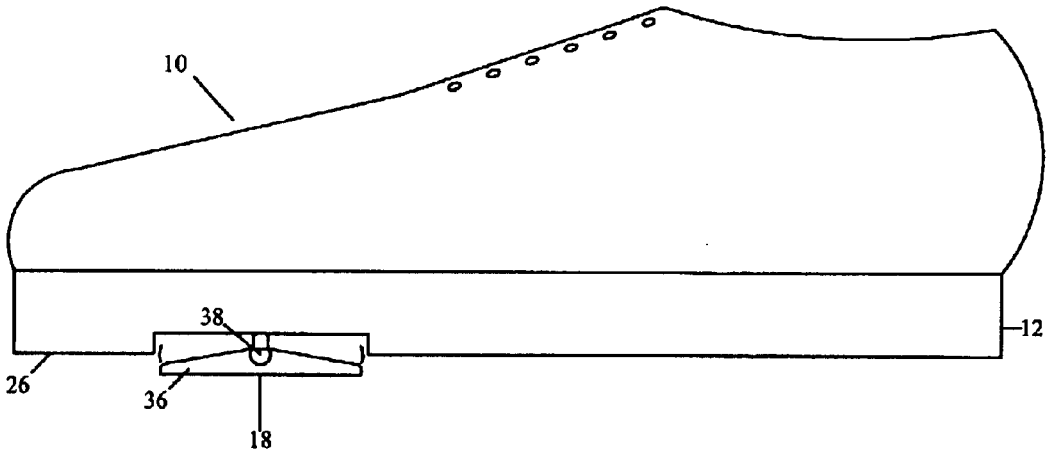
FIG. 11 is a side view of the retractable foot gear of-the present invention having a low friction member including an extended plate formed of a low friction material.

Moreover, as shown in FIG. 11, the low friction member may be constructed as a simple plate 36 which extends below, and alternatively retracts above, the slip resistant surface 26 of the shoe's sole. The plate's engagement surface must have a coefficient of friction lower than that of the shoe's slip resistant surface. However, preferably the plate's engagement surface is constructed of a material having a very low coefficient of friction such as teflon™. Also, the plate may be affixed and biased within the recess by numerous constructions. However, as shown in FIG. 11, the plate may attach to the shoe's sole by a hinged joint 38 to allow the plate to maintain uniform contact with the walking surface independent of the wearer's walk.

Various embodiments of the retractable foot gear of the present invention are described as follows. FIG. 4 illustrates the retractable foot gear wherein the low friction member is in the projected position with the low friction member extending below the slip-resistant surface 26. Conversely, FIG. 5 illustrates the same retractable foot gear with the low friction member 16 in the retracted position. When retracted, the slip-resistant surface 26 of the retractable foot gear 10 maintains contact with the walking surface 20 so as to inhibit the shoe from sliding.

FIGS. 6–8 illustrate another embodiment of a low friction member 16 wherein the roller assembly 22 is biased towards the extended position by hinged brackets 28 and 30. The hinged brackets 28 and 30 include segments of metal or plastic and knuckle joints 32 and 34. The hinged brackets 28 and 30 are bent at the knuckle joints, thereby causing the roller assembly 22 to project from the recess 14. While not shown in the figures, the hinged brackets preferably engage a biasing means, such as a spring, which will deform or move when the hinged brackets are forced into a flattened position. In operation, the hinged brackets remain straightened only while a predetermined force is exerted upon the low friction member's engagement surface 18, which forces the roller assembly 22 upwards into the recess 14. Alternatively, the hinged brackets 28 and 30 may be substituted with a flexible piece of metal which tends to return to its unbent status. Accordingly, a compression member or helical spring assembly 24 is not necessary for practicing the present invention.

FIG. 9 illustrates yet another embodiment of a low friction member including multiple spherical balls having multiple engagement surfaces 18*a*, 18*b*, 18*c*, and 18*d*. As shown, the biasing means incorporates multiple spring assemblies 24*a*, 24*b*, 24*c*, 24*d*, and 24*e*. Optionally, the multiple spring assemblies may bias the roller assembly in an outward position as a single unit, or alternatively, the spring assemblies may bias the individual engagement surfaces downward independent of the remaining engagement surfaces. For example, FIG. 9 illustrates a construction wherein individual engagement surfaces (18*a–d*) may be forced individually into the recess 14, thereby compressing respective spring assemblies (24*a–d*) while leaving remaining engagement surfaces fully projected. As the wearer of the retractable foot gear provides pressure to the foremost engagement surfaces, the intermediate engagement surfaces would be gradually less projected towards the front of the shoe.

While not illustrated, in an additional embodiment of the invention, the roller assembly eliminates a conventional spring assembly for the biasing means, but substitutes a toggle or socket construction. This construction allows the low friction member 16 to move alternately between two positions in response to the inclination of a person's foot and the resulting gravitational force which functions as the biasing means. For example, the pronation of the foot in coordination with a stepping movement and the effects of gravity may be sufficient to automatically return the low friction member to an extended projection. Subsequent supination of the foot, combined with force of the shoe on a hard walking surface, causes the low friction member to retract into the shoe's recess. In such an embodiment, the low friction member may incorporate a gimbal, gimbal ring, or like device, for biasing an engagement surface towards a walking surface until the wearer's foot asserts sufficient force that the engagement surface should yield upward into the recess.

Figure 12:
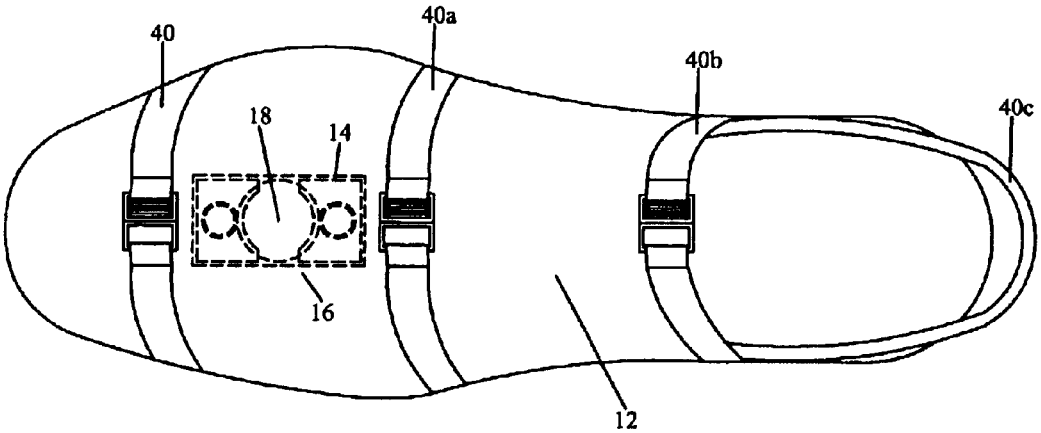
FIG. 12 is a top view of the retractable foot gear of the present invention constructed as a cover for attachment to a wearer's conventional shoe.

The retractable foot gear may be embodied by a shoe that is specially and permanently adapted to include a recess and a low friction member, or alternatively, the retractable foot gear may be constructed to temporarily alter a conventional shoe into one that assists disabled persons to walk. The retractable foot gear constructed to attach to a conventional shoe is shown in FIG. 12. This embodiment of the invention includes a removable sole 12 for temporary attachment to a person's conventional shoes. The shoe is equipped with straps 40–40*c*, such as Velcro™ straps, elastic straps, buckles, or like securing means, which securely wrap around a person's conventional shoes, like a boot. The recess 14, low friction member 16, and engagement surface 18, represented as dashed lines in FIG. 12, are integrated into the removable sole 12 in similar manner as described above.

Advantageously, this embodiment of the retractable foot gear is removable, thus leaving a conventional shoe wholly intact and allowing any conventional shoe to be converted into retractable foot gear. The ability to convert conventional shoes into shoes constructed to assist disabled persons, enables multiple people to use, benefit from, and share a single shoe including retractable foot gear. Moreover, the retractable foot gear can be used with any shoe, interchangeably, and optionally, consecutively by a series of persons with a need for the retractable foot gear and its therapeutic qualities.

Having disclosed my invention in such terms as to enable those skilled in the art to understand and practice it, and, having identified the presently preferred embodiments thereof.

I claim:

1. Retractable foot gear comprising:

a sole including a slip-resistant surface on the sole's underside for providing traction on a walking surface; and a low friction member having an engagement surface for engaging a walking surface, the engagement surface is extendable to below said slip-resistant surface and automatically retractable to above said slip-resistant surface upon a predetermined force engaging said low friction member, said low friction member automatically projecting below said slip-resistant surface when force upon said low friction member is less than said predetermined force.

2. The retractable foot gear of claim 1 further includes a biasing means for automatically projecting said low friction member below the slip-resistant surface when the force upon said low friction member is less than said predetermined force.

3. The retractable foot gear of claim 1 wherein said low friction member is removable from said sole.

4. The retractable foot gear of claim 1 wherein said slip-resistant surface and said low friction member are removable from a shoe.

5. The retractable foot gear of claim 1 wherein said low friction member includes a plate having a coefficient of friction less than the coefficient of friction of the slip-resistant surface.

6. The retractable foot gear of claim 1 wherein said low friction member includes a rotating member.

7. Retractable foot gear comprising:

a sole including a slip-resistant surface on the sole's underside for providing traction on a walking surface;

a recess formed in said sole; and a low friction member positioned in said recess, said low friction member having an engagement surface for engaging a walking surface which is extendable to below said slip-resistant surface, and said engagement surface being automatically retractable into said recess to above said slip-resistant surface upon a predetermined force engaging said low friction member, said low friction member automatically projecting below said slip-resistant surface when force upon said low friction member is less than said predetermined force.

8. The retractable foot gear of claim 7 further comprising a biasing means for automatically projecting said low friction member below the slip-resistant surface when force upon said low friction member is less than said predetermined force.

9. The retractable foot gear of claim 7 wherein said low friction member is removable from a shoe.

10. The retractable foot gear of claim 7 wherein said slip-resistant surface and said low friction member are removable from a shoe.

11. The retractable foot gear of claim 7 wherein said low friction member includes a plate having a coefficient of friction less than the coefficient of friction of the slip-resistant surface.

12. The retractable foot gear of claim 7 wherein said low friction member includes a rotating member.

* * * * *